US005830114A

United States Patent [19]

Halfen et al.

[11] Patent Number: 5,830,114

[45] Date of Patent: Nov. 3, 1998

[54] VARIABLE INCLINE FOLDING EXERCISER

[75] Inventors: Joseph A. Halfen, Woodbury; Peter H. Haugen, Eden Prairie; Lyle R. Hilk, Chaska; Michael R. Johnston, Savage; Tianhong Ouyang, Victoria; Timothy J. Porth, Eden Prairie; Alan Wetterlin, Chaska, all of Minn.

[73] Assignee: Nordictrack, Inc., Chaska, Minn.

[21] Appl. No.: 740,929

[22] Filed: Nov. 5, 1996

[51] Int. Cl.[6] ..... A63B 69/18

[52] U.S. Cl. ..... 482/70; 482/54

[58] Field of Search ..... 482/54, 70, 51–53, 482/71, 57, 148, 964, 908; 70/106, 470; D08/331

[56] References Cited

U.S. PATENT DOCUMENTS

| | | | |
|---|---|---|---|
| 3,040,830 | 6/1962 | Lamprecht | 180/19 |
| 3,130,979 | 4/1964 | Valiquette | 280/43 |
| 4,023,795 | 5/1977 | Pauls | 272/97 |
| 4,047,715 | 9/1977 | Gjessing | 272/132 |
| 4,077,626 | 3/1978 | Newman | 272/128 |
| 4,537,396 | 8/1985 | Hooper | 272/130 |
| 4,591,147 | 5/1986 | Smith et al. | 272/69 |
| 4,625,962 | 12/1986 | Street | 272/132 |
| 4,709,918 | 12/1987 | Grinblat | 272/97 |
| 4,776,582 | 10/1988 | Ramhorst | 272/69 |
| 4,792,134 | 12/1988 | Chen | 272/69 |
| 4,844,449 | 7/1989 | Truslaske | 272/69 |
| 4,867,443 | 9/1989 | Jensen | 272/97 |
| 4,913,396 | 4/1990 | Dalebout et al. | 248/649 |
| 5,016,870 | 5/1991 | Bulloch et al. | 272/73 |
| 5,029,801 | 7/1991 | Dalebout et al. | 248/649 |
| 5,058,881 | 10/1991 | Measom | 272/69 |
| 5,085,426 | 2/1992 | Wanzer et al. | 272/69 |
| 5,102,380 | 4/1992 | Jacobson et al. | 482/54 |
| 5,163,885 | 11/1992 | Wanzer et al. | 482/54 |
| 5,184,988 | 2/1993 | Dunham | 482/54 |
| 5,279,528 | 1/1994 | Dalebout et al. | 482/54 |
| 5,344,372 | 9/1994 | Hung | 482/54 |
| 5,352,167 | 10/1994 | Ulicny | 482/54 |
| 5,372,559 | 12/1994 | Dalebout et al. | 482/54 |
| 5,372,560 | 12/1994 | Chang | 482/54 |
| 5,387,168 | 2/1995 | Bostic | 482/70 |
| 5,407,407 | 4/1995 | Lin | 482/908 |
| 5,411,455 | 5/1995 | Haber et al. | 482/54 |
| 5,429,563 | 7/1995 | Engel et al. | 482/54 |
| 5,460,586 | 10/1995 | Wilkinson et al. | 482/54 |
| 5,499,957 | 3/1996 | Metcalf et al. | 482/70 |
| 5,536,072 | 7/1996 | Chang | 482/52 |
| 5,607,375 | 3/1997 | Dalebout et al. | 482/52 |

OTHER PUBLICATIONS

NordicTrack brochure, "NordicTrack Brings The World's Best Aerobic Exercise Into Your Home.", published in 1992.

"NordicTrack 900 900–T", Assembly & Operating Instructions/Maintenance Manual, published Dec. of 1994.

*Primary Examiner*—Stephen R. Crow

*Attorney, Agent, or Firm*—Westman, Champlin & Kelly, P.A.

[57] ABSTRACT

A cross country ski exerciser has an adjustable forward support that provides for changing the inclination of the frame. The adjustable support permits automatic adjustment of the frame inclination in a series of steps. The adjustment mechanism will reset so that it can be collapsed to a frame lowered position, returned to an operative position and automatically be operative to support the frame. The ski exerciser has folding frame components for compact storage utilizing a single bolt latching arrangement. An arm exerciser supported on the frame has a flywheel for insuring smooth arm movement during the exercise sequence.

11 Claims, 13 Drawing Sheets

104
96
82
80
92B
92
92A
30B
94
30C
30
34
35
36
38
28
10
32
15
21
15A
58
20
54B
26
21
20
12
13
14
24

29
39
39A
39B
39C
42
30
46
44
48
36
50A
50
50B
28
34
31
35
58
32
12
60
54B
56
52

104
103
103
82
105A
105B
100
100
111A
111B
13
13
107B
107A
108
102
102
116
92A
90
98B

VARIABLE INCLINE FOLDING EXERCISER

BACKGROUND OF THE INVENTION

The present invention relates to a whole body exerciser, which includes a flywheel arm exerciser, an adjustable support for changing the elevation or inclination of the bed of the exerciser, as well as a frame assembly that has releasable latches to permit folding for storage.

Cross country ski exercisers sold under the trademark NORDICTRACK® have gained wide recognition and popularity in the exercise field. As the acceptance of exercise machines has increased, the ability to vary the loading level of the exercise regime has become more important. This includes changing the incline of the frame in such an exerciser and changing the load of the arm and leg exercisers. The ability to fold the frame into a compact unit for storage and rapidly unfold it for use has also been a goal of designers of exercise equipment.

SUMMARY OF THE INVENTION

The present invention relates to an exerciser that has a deck or frame that is capable of being adjusted upwardly or downwardly at a front end merely by lifting the frame with the adjustment resetting automatically to permit the forward end to be lowered. In addition, the exerciser of the present invention is a foldable unit that has an upright mast or post for supporting a hip engaging reaction pad and an arm exerciser. The mast folds downwardly, and the arm exerciser, which is mounted at the upper end of the mast, also will fold against the mast for compact storage.

The arm exerciser includes a cord that is operated by movement of the arms in opposite directions, and which drives a flywheel through one way clutch arrangements to provide a smooth loading of the arms during exercising.

Hand rails are provided along the sides of the upright for use when the arms are not being exercised. The rails can be grasped for stability when exercising the lower body only.

The latch mechanisms that are used are simple to disengage and engage, and use a unique, spring loaded pivoting bolt with the pivoting bolt having a head end that latches into a receptacle on a mating part.

The change in elevation of the forward end of the base or frame is accomplished by lifting the frame. The front frame support will pivot downwardly freely and has a ratchet and pawl that stops upward movement at predefined points. The pawl will engage a series of teeth on a ratchet quadrant on the support. The pawl will be automatically disengaged from the ratchet quadrant when the front support is pivoted down beyond a certain selected position. The pawl will then stay disengaged from the ratchet teeth to permit the support to move upwardly toward the frame, and when the support reaches a position close to the frame, a finger that moves with the ratchet quadrant will reset the ratchet pawl so that it will be operative to permit the height adjustment in the series of ratchet steps.

The latches for releasing folding frame parts include a spring loaded bolt having a square shank adjacent its head, and are mounted at either end of the upright mast, that pivotally folds. The square shank will fit into a notch or open slot in an adjacent nonfolding part, and will be either disengaged or engaged from the slot to hold the parts securely together or to permit the one part to fold. This type of latch is used for both the upright post that supports the arm exerciser and the hip pad, and for the arm exerciser itself, which has an elongated frame that can pivot into a folded position adjacent the post for storage.

The arm exerciser includes a flywheel that is driven through cords acting on pulleys through one-way clutches so that the exercise load of the operator's arms as the arms are moved back and forth for exercise is smooth and can be varied.

DETAILED DESCRIPTION OF THE PREFERRED EMBODIMENTS

Figure 1:
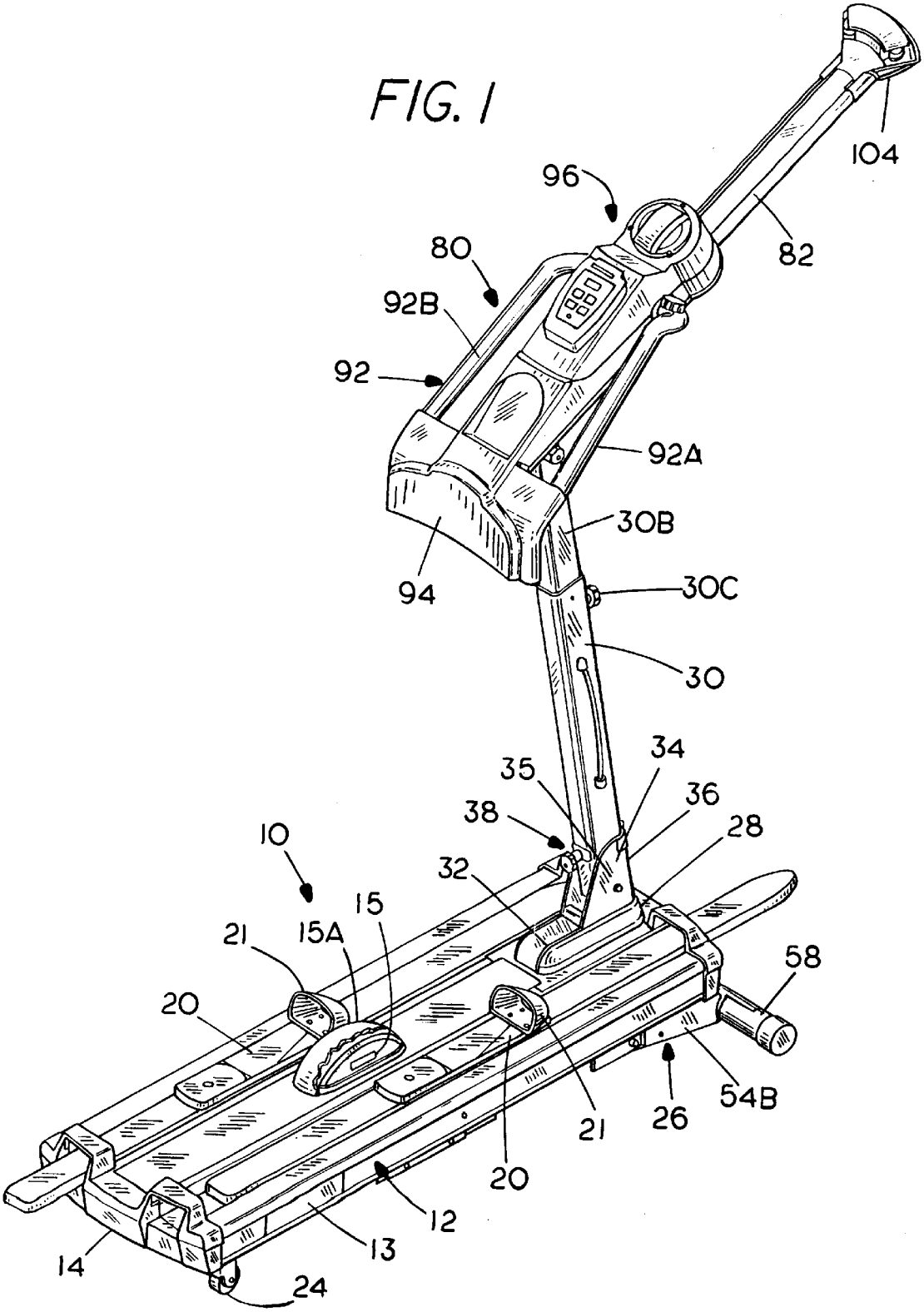
FIG. 1 is a perspective view of an exerciser made according to the present invention.
Figure 2:
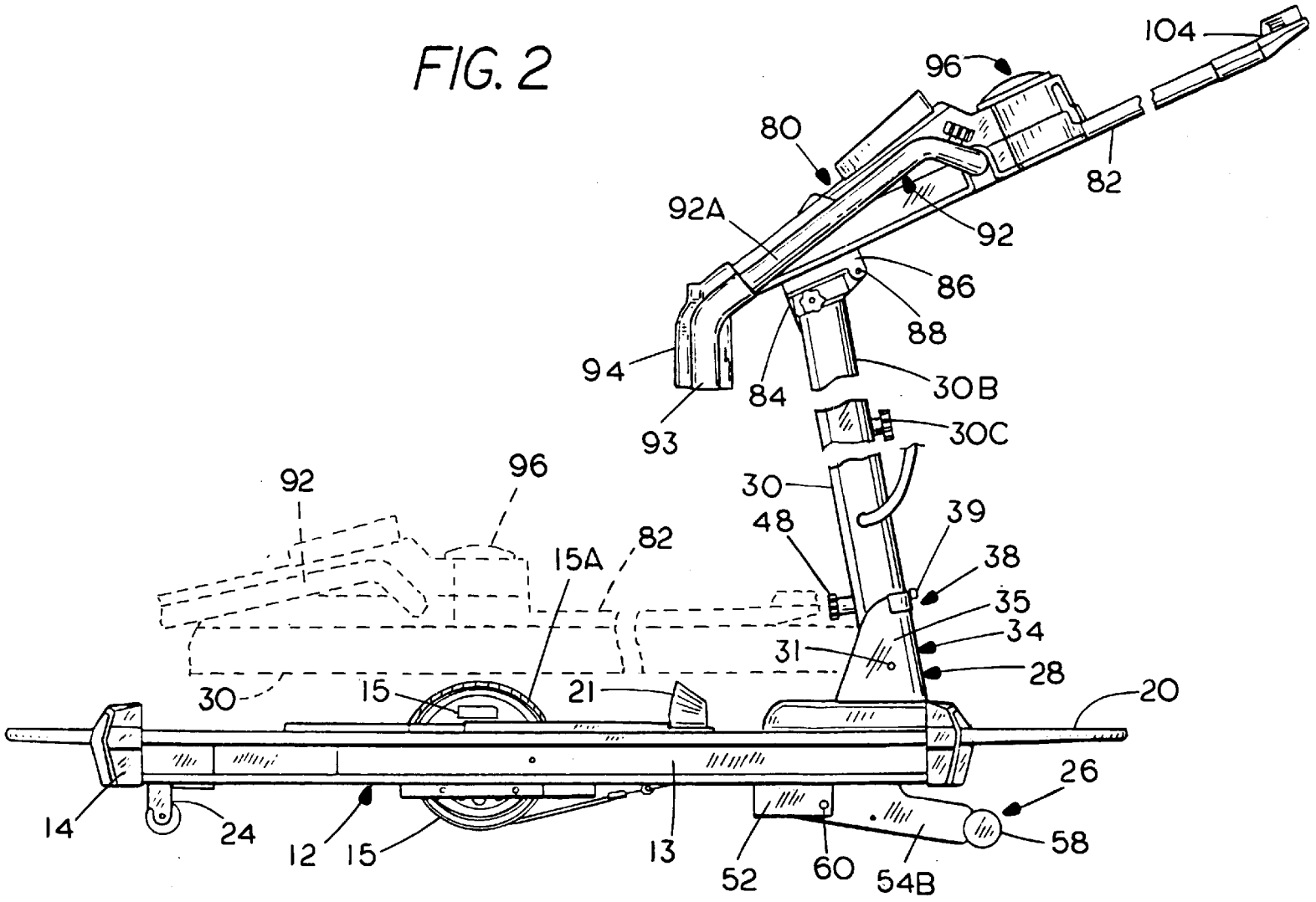
FIG. 2 is a side elevational view of the exerciser of the present invention with parts broken away.

Referring first to FIGS. 1–7, an exerciser illustrated generally at 10 includes a base frame or platform 12 that is of generally conventional design. The frame or platform 12 has side frame members 13 held together with front and rear cross members 14. The frame 12 supports movable elements for exercising the legs of a user. A cross country ski exerciser is illustrated. The mid portion of the frame 12 has a flywheel 15 rotatably mounted thereon through a cross shaft. The flywheel 15 is driven in a conventional manner for a cross country ski exerciser through one-way clutches from rollers that are mounted on the cross shaft which drivably supports the flywheel. The flywheel has a cover 15A that is broken away in FIGS. 1 and 2. The rollers are driven by movable foot supports, as shown simulated skis indicated generally at 20. The skis have toe cups 21 for holding the toe of a user in place, and will be moved back and forth in a simulated cross country skiing motion, which is well known. The skis drive the rollers on the cross shaft as each of the skis is moved on a rear stroke. The known one-way clutches drive the cross shaft and the flywheel. The rollers free wheel relative to the cross shaft during forward motion of the respective simulated ski (see, for example, U.S. Pat. No. 4,023,795 issued to Pauls). The load on the flywheel can be adjusted with an adjustable friction strap riding on the exterior of the flywheel.

The rear portion of the frame 12 is provided with transport rollers 24, and the forward portion of the frame 12 is supported on a vertically adjustable forward frame support assembly 26.

The frame 12 has a post support base 28 on which an upright column or post 30 is mounted for pivotal folding movement. The post support base 28 includes a horizontal member 32 that supports a channel shaped post socket 34 which has an open side facing toward the rear of the frame 12. The post 30 is fitted between side plates 35 of the post socket 34 and is held against an upright support wall 36 of the post socket when the post is in its latched position. The wall 36 is perhaps best shown in FIGS. 6 and 7. The post 30 is mounted on a suitable pivot pin 31 for pivoting movement about a horizontal axis between its generally vertical or assembled position shown in FIGS. 1 and 2 and a folded or collapsed position shown in dotted lines in FIG. 2.

The post 30 is held in its upright position with a latch arrangement illustrated generally at 38, which includes a latch bolt 39. The latch bolt 39 (see FIGS. 6 and 7) has a head 39A, a square latch shank 39B adjacent the head and a threaded portion 39C at an end opposite the head 39A. In installation, the latch bolt 39 is slid through a vertical slot 40 in a front wall 29 of the post 30, and a spring 42 is slid over the threaded portion of the bolt and abuts against the protruding corners at the end of the square shank 39B. The spring 42 also abuts against an inner surface of a wall 30A at the rear side of the upright post 30, as can be seen in FIG. 7. The threaded shank 39C is of a sufficient length to extend through an aperture 44 in the wall 30A. A washer 46 is slipped over the threaded shank and abuts against the exterior of the wall 30A. The washer 46 is configured to the contours of the wall 30A, which as shown has beveled corners. Aperture 44 may be slotted or slightly larger in diameter than bolt 39 to allow for the pivoting movement of the bolt as it moves between the assembled and collapsed positions.

Figure 7A:
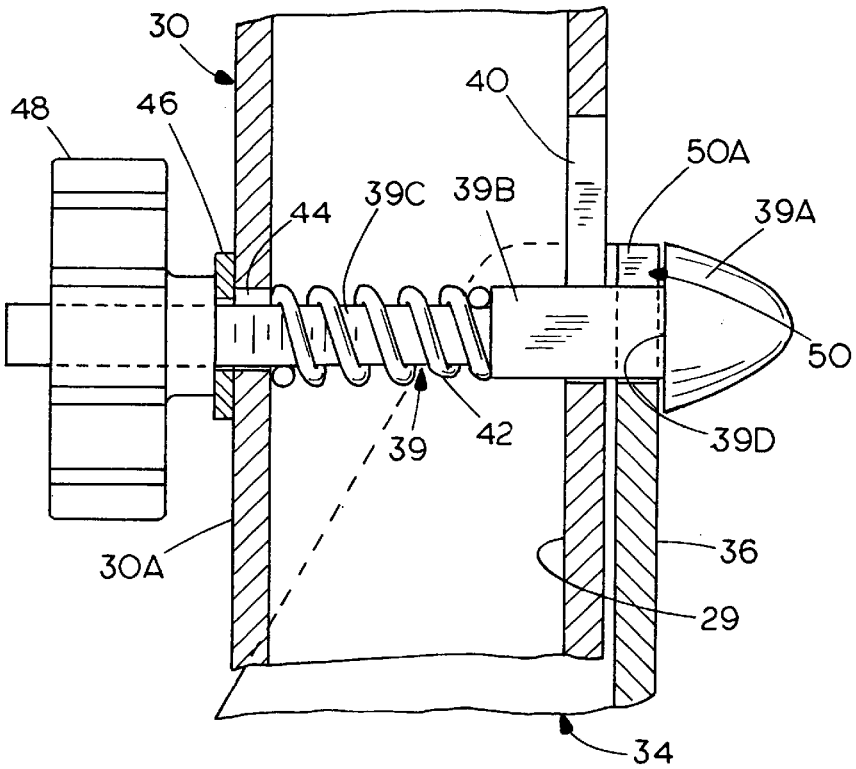
FIG. 7A is a sectional view taken as on line 7—7 in FIG. 6 with the upright support held by the latch.

A manual adjustment knob 48 is threadably mounted on the protruding end of the shank 39C. As seen in FIG. 7A, when the knob 48 is assembled along with the spring and the washer, the spring 42 will compress and tend to urge the head 39A away from the outer surface of the front wall 29. Turning the knob 48 will control the spacing between the underside 39D of the head 39A and the outer surface of the wall 29 to provide a gap 39E. The gap 39E is adjusted to receive the upper edge portions 50A and 50B of the wall 36 that are adjacent to and define an upwardly opening slot or latch notch 50 at the top edge of the wall 36 on the upright post socket 34.

When latched in place, as shown in FIG. 7A, the latch bolt head 39A will prevent the post 30 from being pivoted rearwardly, and will retain the post 30 in its upright, latched position. The knob 48 can be utilized for tightening the parts together, once the latch bolt 39 is latched in place, and to loosen the parts before the post 30 is to be released for folding.

Figure 7B:
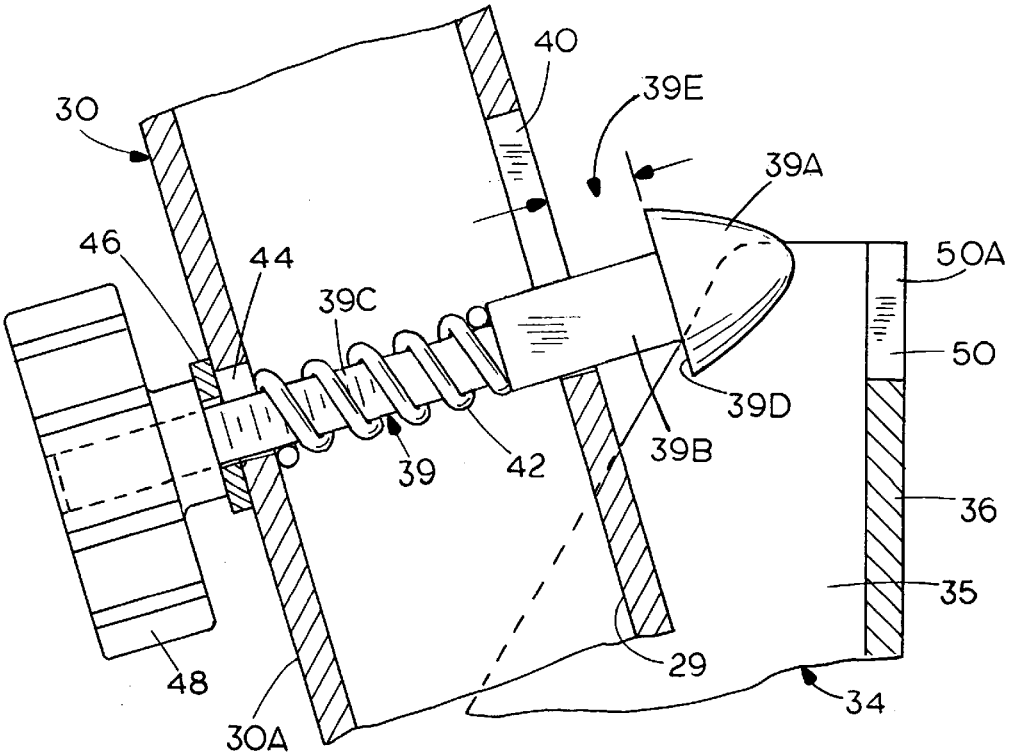
FIG. 7B is a fragmentary sectional view showing the upright support approaching a latched position to illustrate automatic latching.
Figure 7C:
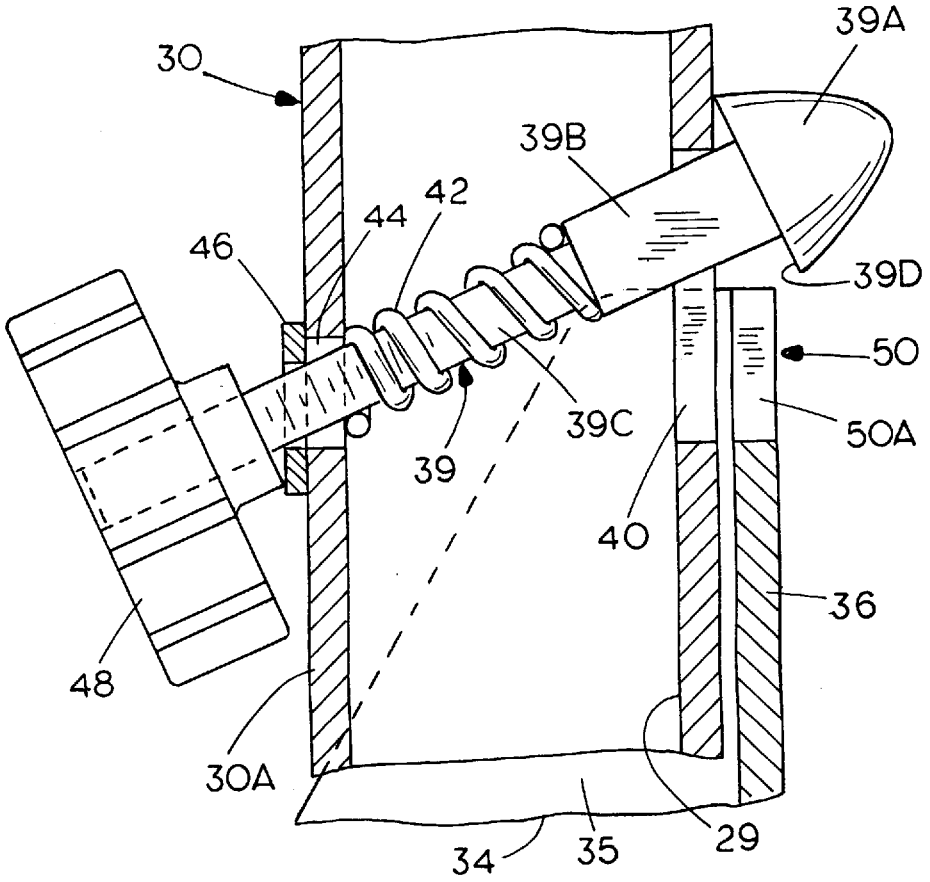
FIG. 7C is a fragmentary sectional view showing the bolt displaced for unlatching.
Figure 8:
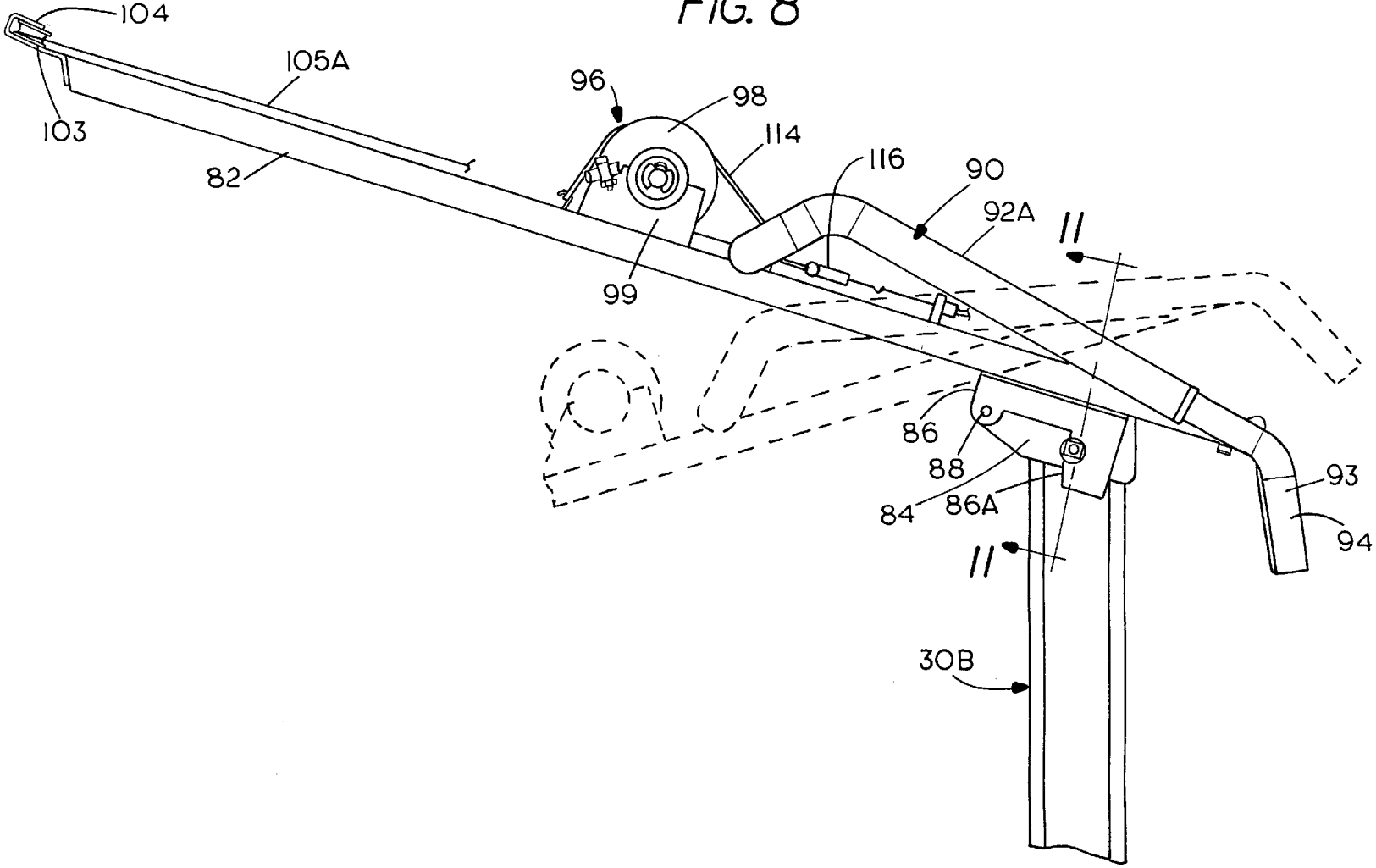
FIG. 8 is a side elevational view of the upper portion of the upright post and an arm exerciser made according to the present invention taken from an opposite side from that shown in FIG. 2.

FIG. 7C schematically shows the middle step in the unlatching procedure. When the knob 48 is loosened so that the head 39A does not clamp the walls 29 and 36 together, the bolt assembly 39 can be unlatched. To unlatch, the bolt assembly 39 is then tilted so that bolt shank 39B is displaced towards one end of the vertical slot 40 of post 30 and the head 39A clears the sidewalls 50A and 50B. The post 30 may then be pivoted back from the post socket 34 to finish the unlatching procedure. Note that as the head 39A clears the sidewalls 50A and 50B, the bolt shank 39B will be displaced out of the latch notch 50.

FIG. 7B schematically shows the post 30 as it approaches a latched position. Note that the spring 42 will maintain the head end 39A of the bolt in an extended condition to permit interaction with the complementary slot walls 50A, 50B. Further note that a gap 39E is produced during this extended condition, which is sufficiently wide enough to admit the sidewalls 50A and 50B of the wall 36 of post socket 34 during the latching operation. Finally note that the spring 42 tends to maintain the bolt assembly in a position where it is orthogonal to the wall 30A of the post 30 and where the bolt shank 39B is at one end of the vertical slot 40, as shown in FIG. 7A.

As the post is swung up too its latched position, the distal end of head 39A will engage the sidewalls 50A and 50B of slot 50. As the post 30 continues to approach the wall 36 of post socket 34 and as the outer surface of the head 39A rides against sidewalls 50A and 50B, the bolt shank 39B will be displaced within vertical slot 40 (see FIG. 7A) . When the edges of the head 39A, and surrounding surface 39D slide past the sidewalls 50A and 50B of wall 36, the bolt shank 39B will automatically seat itself due to the force exerted by the spring.

Figure 3:
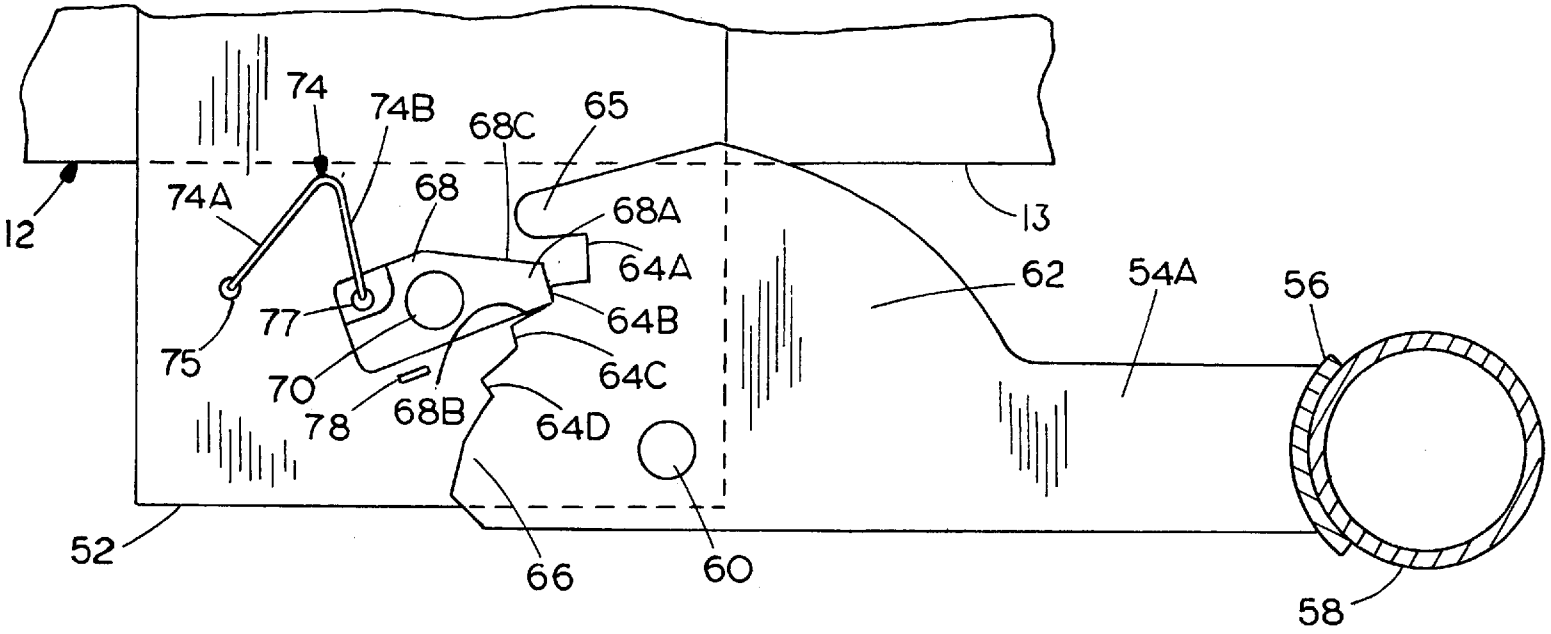
FIG. 3 is a fragmentary side elevational view of a forward end of the exerciser, showing a front frame support that can be varied in height through a ratchet assembly, with the ratchet in a second usable position.
Figure 4:
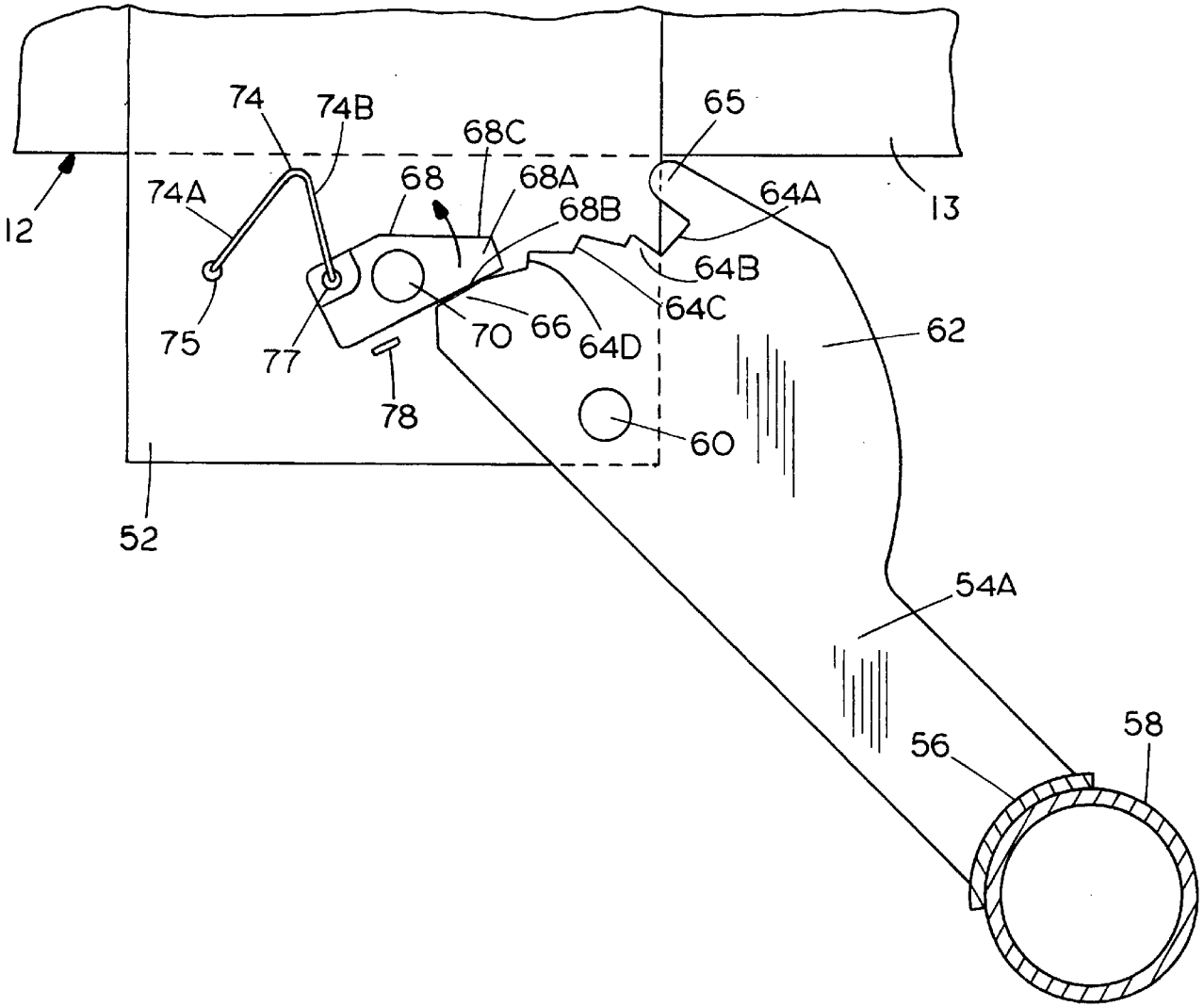
FIG. 4 is a view similar to FIG. 3, with the front support moved to a position to disable or render ineffective a ratchet pawl.
Figure 5:
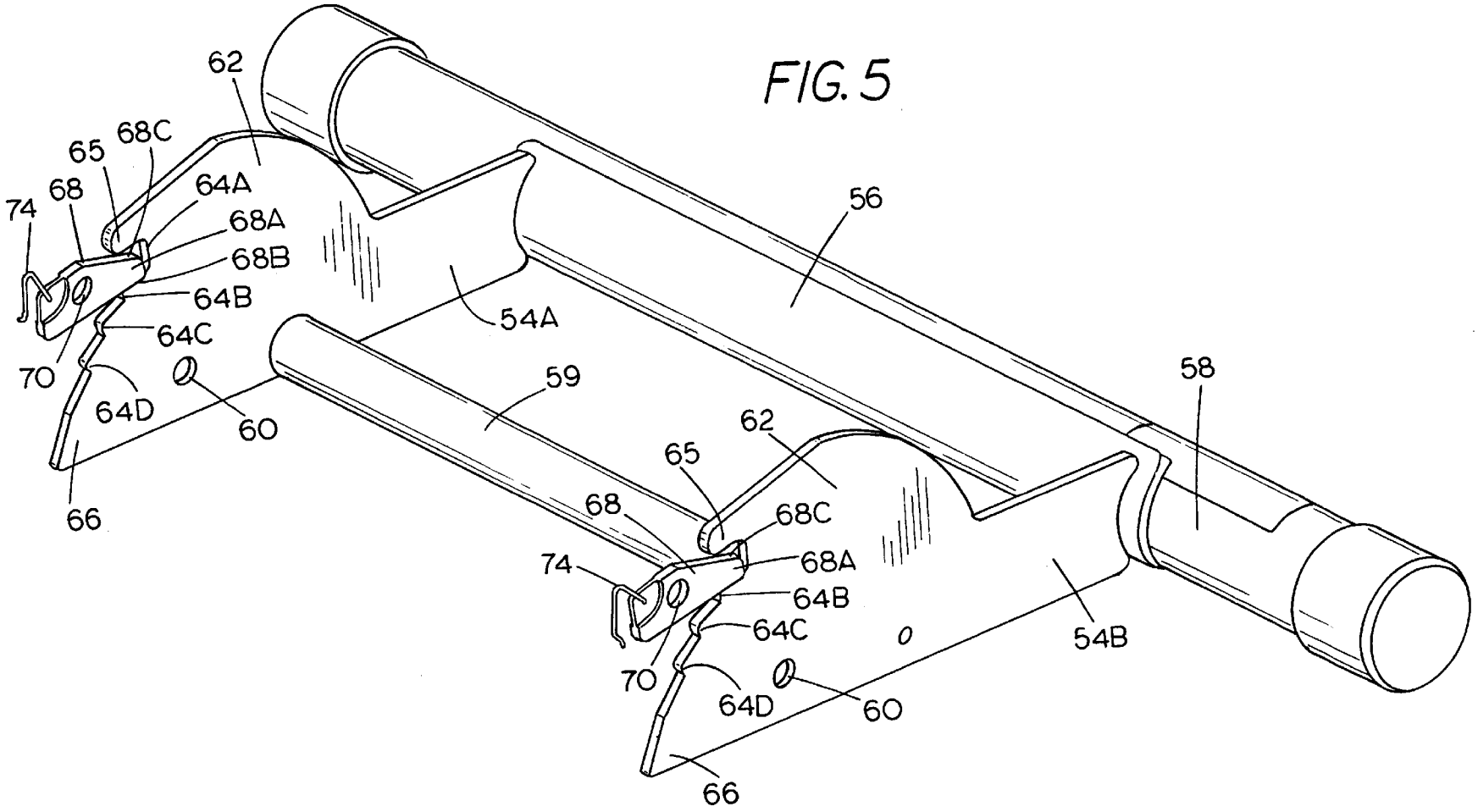
FIG. 5 is a fragmentary perspective view of the front frame support of FIG. 3, with the front frame support moved upwardly to a retracted position wherein the ratchet pawl is being reset to an operative position after the pawl has been disabled as shown in FIG. 4.
Figure 6:
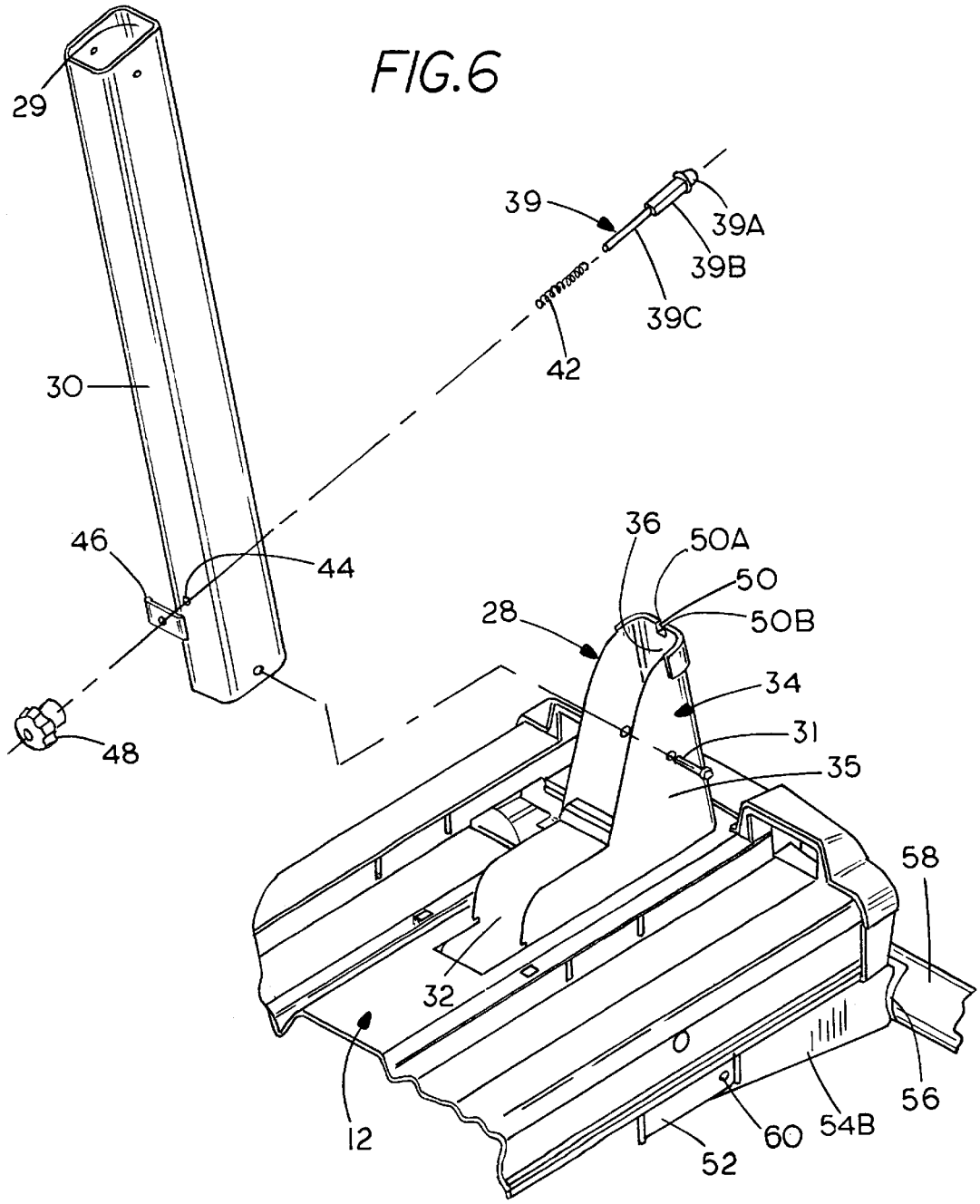
FIG. 6 is a fragmentary exploded view of a forward end of the exerciser frame showing an upright post and a latching mechanism for permitting folding of the post.

The front frame support assembly 26 forms an automatic height (inclination) adjustment device that is shown in greater detail in FIGS. 3, 4 and 5. The side frame members 13, which are spaced apart as shown for supporting the flywheel and the skis and other mechanism, has depending side support plates 52 attached to the inner sides thereof adjacent the forward end of the frame 12. The side support plates 52 extend below the level of the lower edge of the side frame members 13 and are used for supporting the forward frame support assembly 26. As shown, the forward frame assembly 26 comprises a pair of spaced apart arms 54A and 54B, which are adjacent the plates 52, and thus are spaced apart by the spacing of the side frame members 13. The forward ends of these arms 54A and 54B are joined together with a cross member 56 which is part cylindrical, and which is used to support a tubular cross foot 58. The cross foot 58 provides stability and support for the forward end of the cross country ski exerciser frame 12. Also, a cross member 59 is used to reinforce arms 54A and 54B and add rigidity.

Each of the arms 54A and 54B is pivotally mounted on a suitable pin 60 to the respective adjacent side support plate 52, and as can be seen, the arms 54A and 54B each have a ratchet quadrant portion 62 that includes ratchet teeth 64A, 64B and 64C at the rear edge thereof. The ratchet teeth are generally diametrically opposed to the cross foot 58. Each ratchet quadrant 62 is also formed to have an upper reset finger 65 and a lower ratchet pawl release portion 66 at the rear edge of the quadrant.

The side support plates 52 also support ratchet pawls 68 that are mounted on pins 70 for rotational movement. Each pawl 68 has an end land 68A that will engage the respective teeth 64A–64D on the associated ratchet quadrant. As shown in FIG. 3, the pawl will prevent counter clockwise movement of the support arms 54A and 54B when engaged with one of the teeth of the respective ratchet quadrant.

In FIG. 3 the pawl land 68A is illustrated engaging a ratchet tooth 64B, which is the next to lowest usable setting for the forward edge of the frame 12. The cross foot 58 can be positioned downwardly from that position using the two additional ratchet teeth shown to raise the forward end of frame 12.

A separate hairpin type spring 74 is used for biasing each pawl 68 about its pivot pin 70 during use. The hairpin type spring has legs 74A and 74B that are biased to separate in the working position shown in FIGS. 3–5. Leg 74A is held in an opening or other suitable retainer shown at 75 on the side plate 52, and the end of the leg 74B is latched into a small hole 77 on the pawl 68 at an end opposite from the land 68A. The ends of the hairpin spring will pivot in the respective openings 75 and 77.

The biasing of the hairpin spring 74 is such that when in the ratcheting or working position, as shown in FIG. 3, the ratchet pawl 68 will be spring loaded in a clockwise direction, and the land 68A will be biased against and ride upon the quadrant edge surfaces defining the ratchet teeth 64A, 64B, 64C and 64D. The ratchet permits the arms 54A and 54B to pivot in clockwise direction when the forward end of the frame 12 is lifted. The height or elevation of the frame forward end thus can be automatically adjusted merely by lifting that end of frame 12 to obtain the adjustment available with the teeth 64A, 64B, 64C and 64D.

In order to release the pawl 68 from the ratchet teeth to permit the tubular cross support 58 to move upwardly toward frame 12 and thus lower the forward end of the frame 12, the reset section 66 of the ratchet quadrant is formed so it acts as shown in FIG. 4. When the tubular cross support 58 moves away from frame 12 beyond its normal operating position, the reset portion 66 of the edge of the ratchet quadrant 62 will contact the lower edge of the pawl 68, as shown at 68B. The continued movement of the support will pivot the pawl 68 in counter clockwise direction until it goes "overcenter" with respect to the force from the hairpin spring 74. The spring 74 acts through the ends of legs 74A and 74B, which are connected to the opening 75 in plate 52 and to the opening 77 in the pawl 68. The ends of the spring are attached in locations to provide the overcenter action.

Once the reset section 66 causes the spring to go overcenter in relation to the pawl, the pawl will be biased in a counter clockwise direction and the spring 74 will retain the land 68A spaced away from the teeth 64A–64D under spring load. The arms 54A and the support assembly 26 are thus permitted to move toward the frame 12. The forward end of the frame 12 can thus move downwardly toward a supporting surface. The ratchet pawl land 68A will remain spaced from the teeth to permit this movement, until it is reset to working or operative positions. A stop 78 is provided to prevent the pawl 68 from pivoting too far counter clockwise.

As the tubular cross support 58 moves adjacent the frame 12, the ratchet moves until the reset finger 65 strikes the forward edge 68C of the pawl 68. This will reset the pawl generally as shown in FIG. 5. When the pawl 68 is moved clockwise about pivot 70 a sufficient amount by reset finger 65, the end 74B of the hairpin spring 74 secured in the opening 77 will again move to an overcenter position where the spring action will tend to rotate the pawl 68 in a clockwise direction to its working position.

An automatic inclination or height adjustment in a series of steps equal to the spacing between the ratchet teeth is obtained, along with an automatic pawl release for lowering the front end of the frame 12 and restoring the pawl to its usable position to permit incremental height adjustment.

The upper end of the upright post 30, as shown in FIG. 1, has a telescoping section 30B for height adjustment. The post sections can be held together in a variety of desired positions with clamps or pins for example. As shown a spring loaded pin, having a manual knob 30C can be pulled to release the pin, which fits into one of a series of adjustment holes in post section 30B.

The upper end section 30B of the post 30 supports an arm exerciser and reaction pad assembly 80. The assembly 80 is capable of being folded relative to the upright post 30 for storage. FIG. 1 shows suitable shrouds over the arm exerciser assembly, while FIGS. 8–13 do not show the shrouds in place, and illustrate the components used. The upright post section 30B has a bracket 84 at its upper end that carries a pin 88 which pivotally mounts a second bracket 86. Bracket 86 has a forwardly extending arm 82 secured thereto. The bracket 86 will pivot relative to the bracket 84, about pin 88.

The arm 82 supports a tubular frame work 90 (See FIGS. 8 and 12), which is secured to the arm 82. The frame 90 has two side members or rails 92A and 92B extending back past the post 30 to a position spaced rearwardly from the post 30. These rails 92A and 92B provide handgrips for a user of the exerciser as an alternative to the cord/handle assembly. The rails also carry a reaction support 94 (see also FIG. 1) that is sometimes called a "hip pad" or a "pelvis support." The support 94 is used by the person exercising to react to loads caused from movement of the foot supports (simulated skis as shown) again at a flywheel, and loads from the upper arm exerciser flywheel. The reaction member 94 is mounted between depending ends 93 of the rails 92A and 92B. Suitable cross members can be used at any desired location between the arms 92A and 92B.

The forwardly extending arm 82 mounts an arm loading assembly 96 that includes a flywheel 98 supported on a shaft 108 which in turn is mounted on a bracket 99. The flywheel 98 is connected to the shaft 108 with a pin 115. The flywheel 98 is made to be driven by movement of a cord 100 that has hand grips 102 on opposite ends. The cord 100 is reaved through pulleys 103 that are mounted onto a support assembly 104 at an outer (forward) end of the arm 82. The cord 100 has lengths 105A and 105B that are positioned on opposite sides of the arm 82. The lengths 105A and 105B pass around pulleys 107A and 107B, respectively that are mounted on the shaft 108 that mounts the flywheel 98. Shaft 108 can be mounted to bracket 99 on suitable bearings 110 (see FIG. 13).

The cord lengths 107A and 105B pass over the pulleys 107A and 107B so that the cords will drive the pulleys when the cords are moved longitudinally by pulling on one or the other of the hand grips 102. The cord extends from the pulleys 107A and 107B over guide pulleys 111A and 111B that are mounted on bracket 99 and are inclined sufficiently to guide the lengths of the cord around the forward edge of the flywheel 98. The cord is thus guided between the pulleys 107A and 107B with pulleys 111A and 111B.

Figure 13:
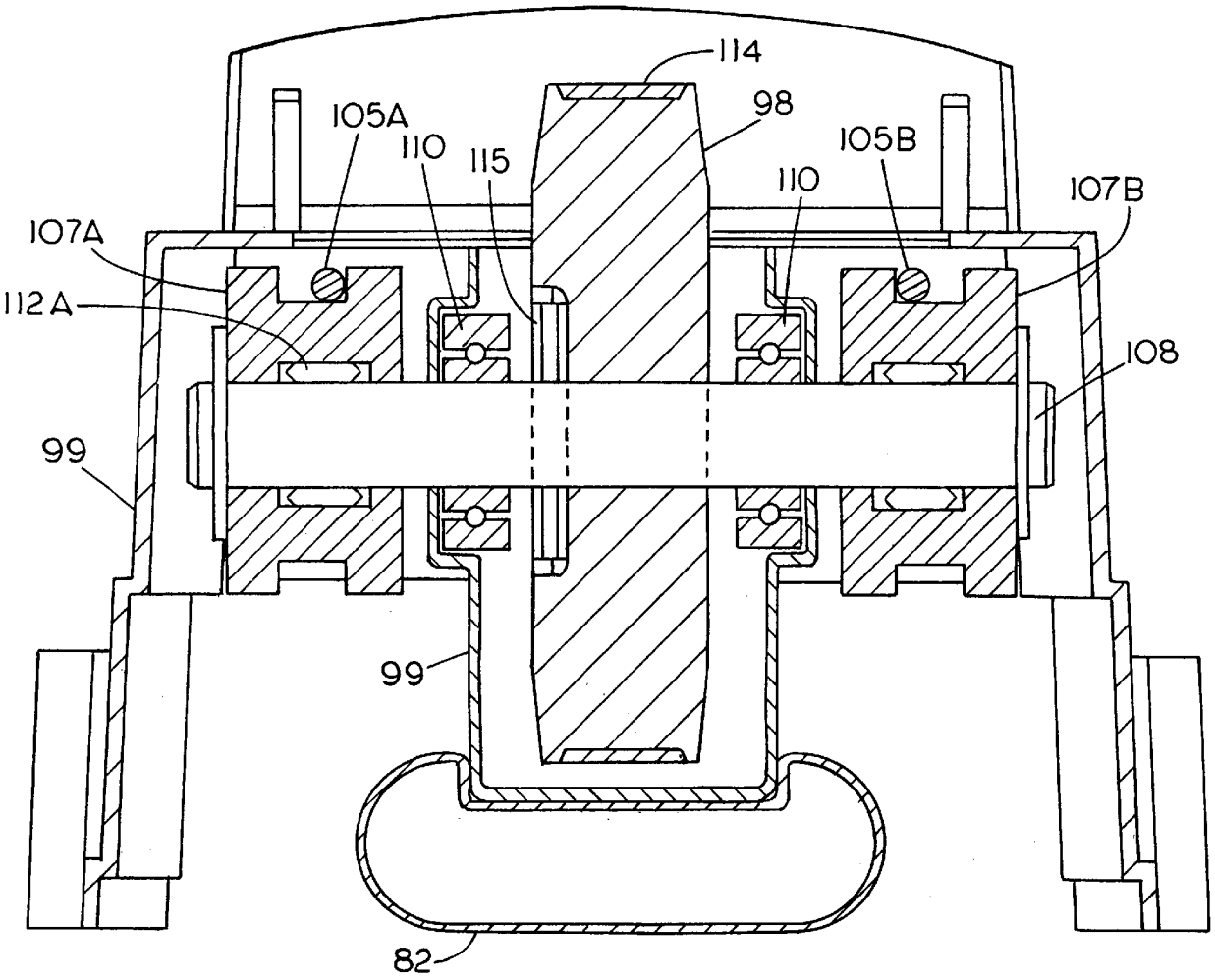
FIG. 13 is a sectional view thereof taken on line 13—13 in FIG. 12.

The pulleys 107A and 107B are connected to the shaft 108 through suitable one-way clutches 112A and 112B (see FIG. 13). The one-way clutches are well known, and will free wheel in one direction and drive shaft 108 from the respective pulley when that pulley is rotated in the opposite direction. As the cord 100 is moved back and forth, the pulleys 107A and 107B will alternately drive the flywheel 98. A suitable friction belt 114 is provided over the flywheel, and is loaded through a spring load assembly 116 and an adjustable length cable assembly 115 to provide friction force on the flywheel. The manual adjustment knob 116 can be turned to changed the load on friction belt 114 to control the load that is needed to be exerted on the cord 100 to drive the flywheel. This will permit the person exercising to modify the arm loads in the exercising regime.

Figure 10:
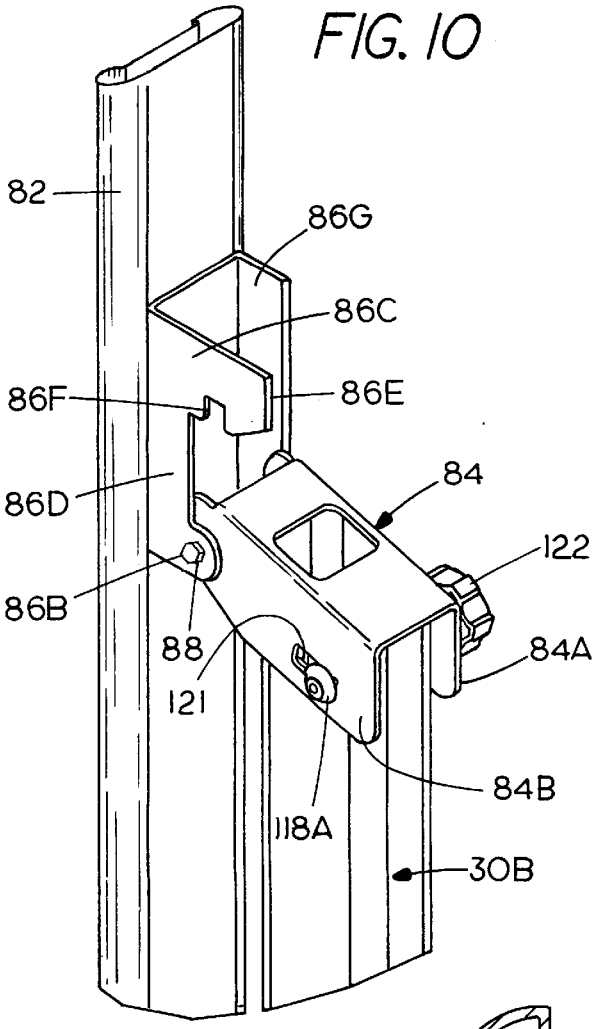
FIG. 10 is an enlarged perspective view of a pivot structure and latch assembly used for the arm exerciser of the present invention.
Figure 11:
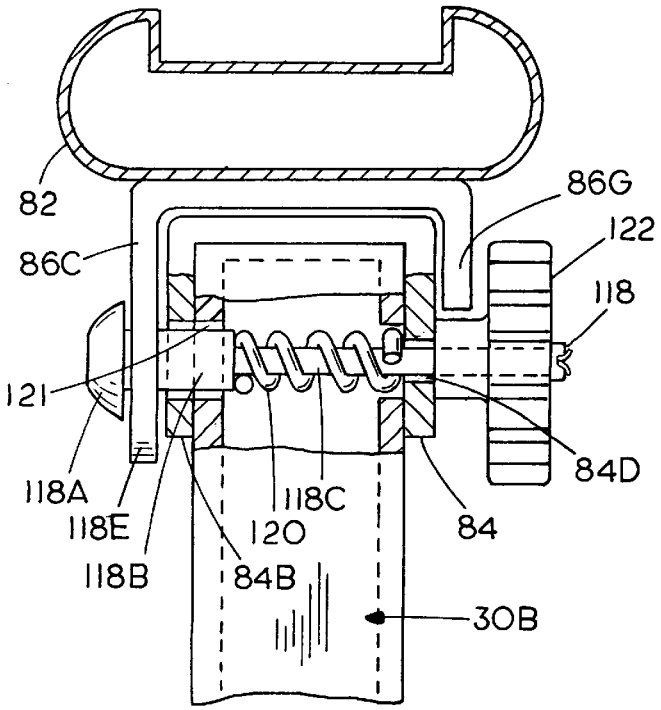
FIG. 11 is a sectional view taken as on line 11—11 in FIG. 8.
Figure 12:
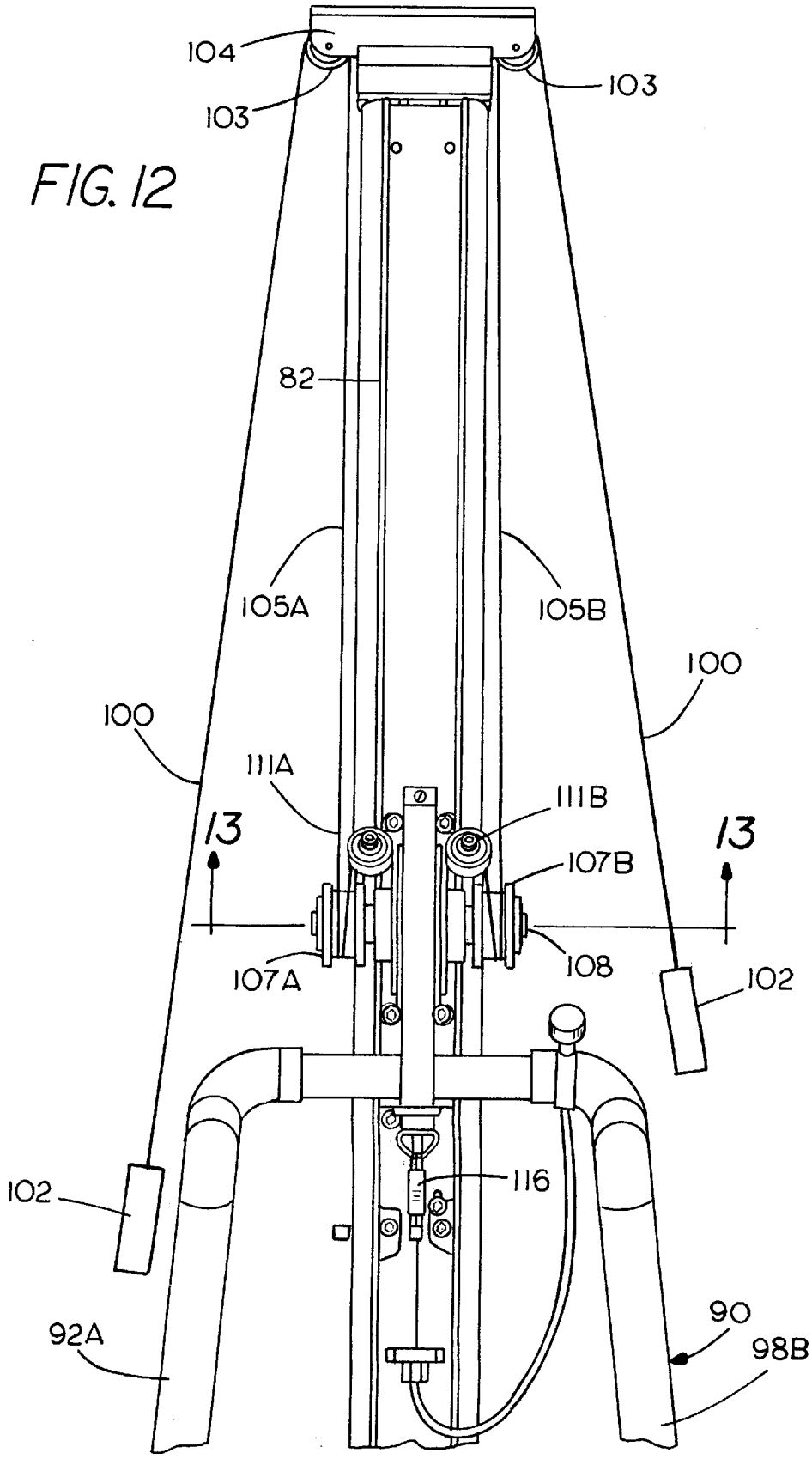
FIG. 12 is a top plan view of a portion of the arm exerciser.

The brackets 84 and 86, as stated, are pivotally mounted together with a pivot pin 88 with suitable pins. The brackets are latched in the operative position using a latch similar to the latch for securing the upright post 30 in its working position. Referring to FIGS. 10 and 11, it can be seen that the bracket 84 is an inverted channel having depending legs 84A and 84B that are mounted on opposite sides of the upright post section 30B and secured to the post. Leg 84A has an aperture 84D therein for receiving a latch bolt 118, which is constructed as bolt 39, and includes a head 118A, a square shank 118B near the head, and a threaded shank 118C. The latch bolt 118 is of length to extend between the legs 84A and 84B of the bracket 84, with the head 118A spaced outwardly from the sidewall 84B a desired amount for permitting latching. The post upper section 30B also has apertures for the bolt.

A spring 120 fits over the threaded shank 118C, and will urge the head 118A away from the leg 84B. A manual adjustment knob 122 is threaded on an outer end of the threaded shank 118 and abuts against the outer surface of wall 84A. The square shank 118B extends through a horizontal slot 121 formed in the leg 84B and in the sidewall of the post section 30B, as shown in FIG. 10.

The bracket 86 for the arm 82 has depending ears 86B that are used for pivotally mounting the bracket 86 at pivot pin 88 to the legs 84A and 84B, respectively. The bracket 86 has a side flange 86C that has a cutout or recess 86D forming a latch portion 86E, with a latch notch or open ended slot 86F defined in one edge thereof opening toward the recess 86D.

The opposite leg 86G is shorter than the latch portion 86E, and is trimmed so that the lower edge will clear the knob 122 when the bracket 86 is in its latched position as shown in FIG. 11.

Figure 9:
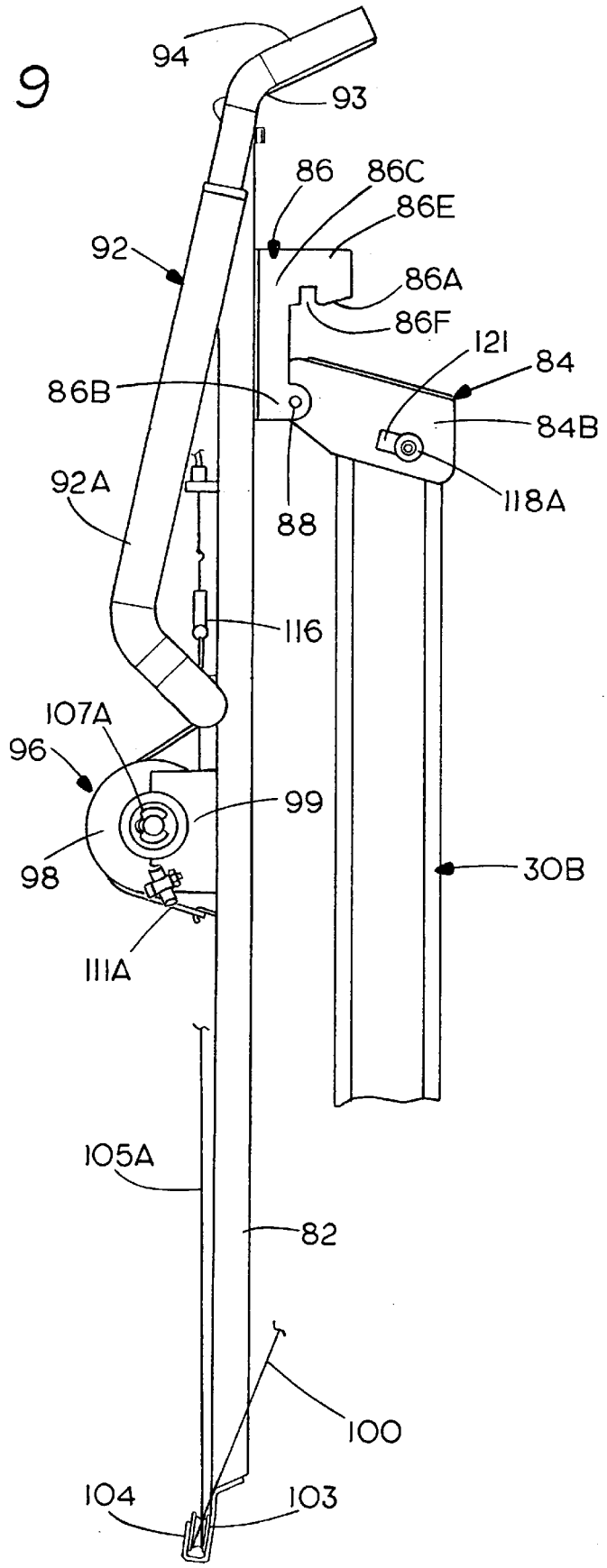
FIG. 9 is a view similar to FIG. 8, showing the arm exerciser in a folded position.

When the bracket 86 is in its latched position, the head 118A of bolt 118 is on the outside of the latch portion 86E, and the square shank 118 fits into the latch notch 86F to hold the arm exerciser assembly from pivoting about pivot pin 88. The handle or knob 122 can be manipulated to slide the square shank 118B in the slot 121 a sufficient distance to clear the edges of the latch notch 86F and permit the bracket 86 to be released. As seen in FIG. 9, the edge 86A of the side flange 86C that has the notch 86F provides a camming action so that when the bracket 86 is moved toward its latched position the edge 86A will cause the square shank portion 118B that is exposed between the head 118A and the outer surface of flange 84B to move in response to the force of the spring 120 along the slot 121, and the bracket 86 will automatically latch in place. The bracket 86 is latched through the one flange 86C and the latch portion 86E.

The knob 122 can be tightened to hold the unit securely if desired, but the spring 120 will keep the latch bolt 118, against the back side of the notch 122 as shown in FIG. 10 when it is released. The latch bolt 118 will latch easily and securely.

Thus, the present exerciser permits folding for storage, easily and simply, using a folding action for both the upright support post and the arm exerciser assembly. It will be noted that the pivot position for the bracket 86 is such that the reaction member 94 will pivot generally parallel to the upright post 30, 30A and there will be little protrusion of the assembly when it is in its folded position.

The automatically adjustable front support for permitting changing the elevation of the frame makes it quite simple to provide adjustment, which will change the loads needed to operate the exerciser, with the different inclinations of the frame.

The embodiment shown is for a cross country ski exerciser, but the elevational control and the arm exerciser will work on treadmills and even frames which support only the arm exerciser.

Although the present invention has been described with reference to preferred embodiments, workers skilled in the art will recognize that changes may be made in form and detail without departing from the spirit and scope of the invention.

What is claimed is:

1. An exerciser comprising a base frame, a movable support on the base frame for permitting movement to exercise legs of a user, a post adjacent the one end of the base frame, a support for the post comprising a base having a pivot for pivotally mounting one end of the post, and an upright wall generally parallel to the pivot, said post being mounted for pivotal movement from a position generally parallel to the base frame to an upright position adjacent the upright wall, and a latch comprising a bolt having a latch shank and a threaded end extending through a wall of the post, the bolt having a head attached to the latch shank and positioned on the exterior of the post, a spring load member for urging the head away from an adjacent surface of the post and for urging the latch shank substantially perpendicular relative to the wall of the post, an adjustable knob acting in opposition to the spring load member for controlling the spacing of the head from the post, and wherein the upright wall of the support for the post has a latch notch for receiving the latch shank of the bolt with the head on the opposite side of the upright wall from the post for holding the post latched to the upright wall.

2. The exerciser of claim 1, wherein said latch shank extends through a slot in a wall of the post, the slot permitting the latch shank to move between first and second positions wherein the head will clear the slot walls of the post support and wherein the latch shank is in the latch notch.

3. The exerciser of claim 1 and an arm exerciser mounted at the upper end of said post, a bracket assembly for pivotally mounting the arm exerciser for movement relative to the post from a position where the arm exerciser extends laterally outwardly from the post to a position where it generally is adjacent a length of the post.

4. The exerciser of claim 3, wherein the arm exerciser comprises a cord mounted on pulleys to permit movement of the cord in opposite directions, and a flywheel mounted on the arm exerciser and including a rotational drive to the flywheel driven by movement of said cord in opposite directions for providing a load on the cord.

5. The exerciser of claim 3 and a hip pad mounted on said arm exerciser and extending to overlie at least a portion of the base frame of the exerciser to provide a load reaction member for a person exercising.

6. The exerciser of claim 3, wherein the bracket assembly for mounting said arm exerciser comprises a first bracket mounted on an upper end of said post and a second bracket mounted on the arm exerciser and pivotally mounted to the first bracket, an arm exerciser latch assembly for latching the second bracket to prevent pivotal movement of the second bracket relative to the first bracket.

7. The exerciser of claim 6, wherein said arm exerciser latch assembly comprises a latch bolt slidably mounted on the first bracket and urged toward a first position, a slot in the first bracket for slidably guiding the latch bolt to a second position, and a latch notch on the second bracket adapted to be engaged by the latch bolt to retain the first and second brackets from pivotal movement when the latch bolt is in its first position.

8. The exerciser of claim 7 including a guide edge surface on the second bracket leading to the latch notch, said guide edge surface engaging the latch bolt and urging the latch bolt from its first position along the slot as the second bracket moves to a latched position to permit the latch bolt to slide along the guide edge surface and to move into the latch notch, and return to its first position under a load urging the latch bolt toward its first position.

9. An exerciser comprising a base frame;

an exercising assembly supported by the base frame;

at least a first portion of the exercising assembly being pivotally mounted to a second portion of the exercising assembly; and a releasable latch for holding the two portions of the exercising assembly from pivoting and being releasable to permit the two portions of the exercising assembly to pivot relative to each other, comprising;

a bolt slidably mounted on the first portion and urged toward a first position, a slot in a wall of the first portion of the exercising assembly for guiding movement of the bolt to a second position, and a latch notch on the second portion of the exercising assembly having an open end and adapted to be engaged by the bolt to retain the first and second portions from pivotal movement when the bolt is in its first position, said bolt clearing the latch notch in its second position to permit relative pivotal movement of the first and second portions of the exercising assembly.

10. The exerciser of claim 9, wherein the bolt is spring loaded to extend from a surface of the wall of the first portion, and has a head and a rectilinear shank portion extending from the head for engaging the latch notch.

11. The exerciser of claim 10, wherein the bolt has a threaded shank joining an end of the square shank and extending through a second wall of the first portion, the spring load comprising a compression spring acting between the end of the square shank and an adjacent surface of the second wall, and a hand knob threaded on the threaded shank on an opposite side of the second wall from the spring to permit adjusting the extension of the square shank from the slot in the first portion of the exercising assembly.

* * * * *

UNITED STATES PATENT AND TRADEMARK OFFICE

CERTIFICATE OF CORRECTION

PATENT NO. : 5,830,114

DATED : Nov. 3, 1998

INVENTOR(S) : Joseph A. Halfen, Peter H. Haugen, Lyle R. Hilk, Micheal R. Johnston, Tianhong Ouyang, Timothy J. Porth, Alan Wetterlin

It is certified that error appears in the above-identified patent and that said Letters Patent are hereby corrected as shown below:

Col. 1, line 33, after "through" change "one way" to -- one-way--

Col. 6, line 32, after "shown)" change "again at" to --against--

Col. 6, line 51, after "lengths" change "107A" to --105A--

Col. 7, line 2, after "cable assembly" delete --115--

Col. 7, line 9, after "pin 88" delete "with suitable pins"

Col. 7, line 60, after "notch" change "122" to --121--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*